US008151590B2

(12) United States Patent
Flores et al.

(10) Patent No.: US 8,151,590 B2
(45) Date of Patent: Apr. 10, 2012

(54) BACK LIGHT IN ICE STORAGE AREA

(75) Inventors: Laura Esther Flores, Nuevo Leon (MX); Bruce A. Kopf, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 608 days.

(21) Appl. No.: 12/277,727

(22) Filed: Nov. 25, 2008

(65) Prior Publication Data

US 2010/0126194 A1 May 27, 2010

(51) Int. Cl.
*F25D 23/00* (2006.01)
*F25D 11/02* (2006.01)
*F25D 3/02* (2006.01)

(52) U.S. Cl. ..... 62/264; 62/441; 62/459

(58) Field of Classification Search ..... 62/126, 62/449, 459, 264, 441, 344
See application file for complete search history.

(56) References Cited

U.S. PATENT DOCUMENTS 4,719,765 A 1/1988 Hooper et al.
6,478,445 B1 11/2002 Lange et al.
6,519,965 B1 2/2003 Blanchard, Sr. et al.
6,601,984 B2 8/2003 Yamamoto et al.
6,726,341 B2 4/2004 Pashley et al.
6,873,262 B2 3/2005 Midlang
6,997,007 B1 2/2006 Wyatt
7,121,675 B2 10/2006 Ter-Hovhannisian
7,197,888 B2 4/2007 LeClear et al.
7,210,808 B2 5/2007 Malpetti
7,338,180 B2 3/2008 Wing
2008/0037239 A1 2/2008 Thomas et al.

FOREIGN PATENT DOCUMENTS

JP 09269171 A * 10/1997

* cited by examiner

*Primary Examiner* — Chen Wen Jiang

(74) *Attorney, Agent, or Firm* — Kirk W. Goodwin; Mckee, Voorhees & Sease

(57) ABSTRACT

A refrigerator includes a refrigerator cabinet, at least one compartment disposed within the refrigerator cabinet, a door for providing access to one or more of the at least one compartment, an ice container at the door, an LED housing proximate the ice container, and at least one LED disposed within the LED housing for providing illumination of the ice container. In addition to providing lighting, the at least one LED may used to indicate status information associated with the refrigerator.

22 Claims, 6 Drawing Sheets

| CONDITION | LED |
|---|---|
| ICE BIN FULL | CONTINUOUS ON |
| ICE BIN EMPTY | FLASH ON 1 SEC. |
| ICE BIN TILTED | FLASH ON 2 SEC. |
| ICE BIN NOT DOCKED | FLASH ON 3 SEC. |

| CONDITION | LED1 | LED2 | LED3 |
|---|---|---|---|
| ICE BIN EMPTY | ON | ON | ON |
| ICE BIN FULL | OFF | ON | OFF |
| ICE BIN TILTED | ON | OFF | ON |
| ICE BIN NOT DOCKED | FLASH | FLASH | FLASH |

BACK LIGHT IN ICE STORAGE AREA

FIELD OF THE INVENTION

The present invention relates to refrigerators. More specifically, but not exclusively, the present invention relates to refrigerators with ice being stored in an ice storage area remote from a freezer.

BACKGROUND OF THE INVENTION

Refrigerators typically include ice storage bins. In one configuration of a refrigerator, the ice storage container may be located at the door of the refrigerator. Either the ice is made at the door and stored in the ice storage container or else the ice is made elsewhere such as in a freezer compartment or ice maker compartment and the ice is conveyed to the ice storage container at the door. In typical operation, a user can dispense ice using a water and ice dispenser located at the door. Alternatively, the user can open the door of the refrigerator to access the ice bin. However, the ice container is typically in some form of insulated compartment, as the ice must be kept at a temperature lower than the temperature of the fresh food compartment. Thus, a user must perform additional steps in order to access the ice. This may include opening a compartment door or opening or removing the ice bin. Even if an ice container is made of clear plastic, the level of ice within the ice container may be difficult to discern as the ice container is located on the door and away from conventional light sources associated with a refrigerator. Thus, a user may have to remove the ice container in order to check the level of ice in the ice storage bin. What is needed is a better way to check the level of ice in an ice storage bin.

SUMMARY

According to one aspect of the present invention, a refrigerator is provided. The refrigerator includes a refrigerator cabinet, at least one compartment disposed within the refrigerator cabinet, a door for providing access to one or more of the at least one compartment, an ice container at the door, an LED housing proximate the ice container, and at least one LED disposed within the LED housing for providing illumination of the ice container.

According to another aspect of the present invention, a refrigerator includes a housing, a fresh food compartment within the housing, a freezer compartment within the housing, a fresh food compartment door for providing access to the fresh food compartment, a freezer compartment door for providing access to the freezer compartment, an icemaker within the housing, and an ice storage container operatively connected to the fresh food compartment door, the ice storage container being at least partially formed from a clear plastic material. The refrigerator further includes at least one LED positioned on the fresh food compartment door for illuminating the ice storage container.

According to another aspect of the present invention, a refrigerator includes a refrigerator cabinet, at least one compartment disposed within the refrigerator cabinet, a door for providing access to one or more of the at least one compartment, and an ice container disposed within the refrigerator, the ice container being at least partially formed of a light transmissive material. There is at least one LED disposed within the refrigerator proximate the ice container for providing illumination of the ice container. There is also an electronic control system operatively connected to the at least one LED and adapted for controlling the at least one LED to provide status information.

DETAILED DESCRIPTION

Although the present invention is described with respect to various embodiments, the present invention is not to be limited to the specific embodiments described herein.

Figure 1:
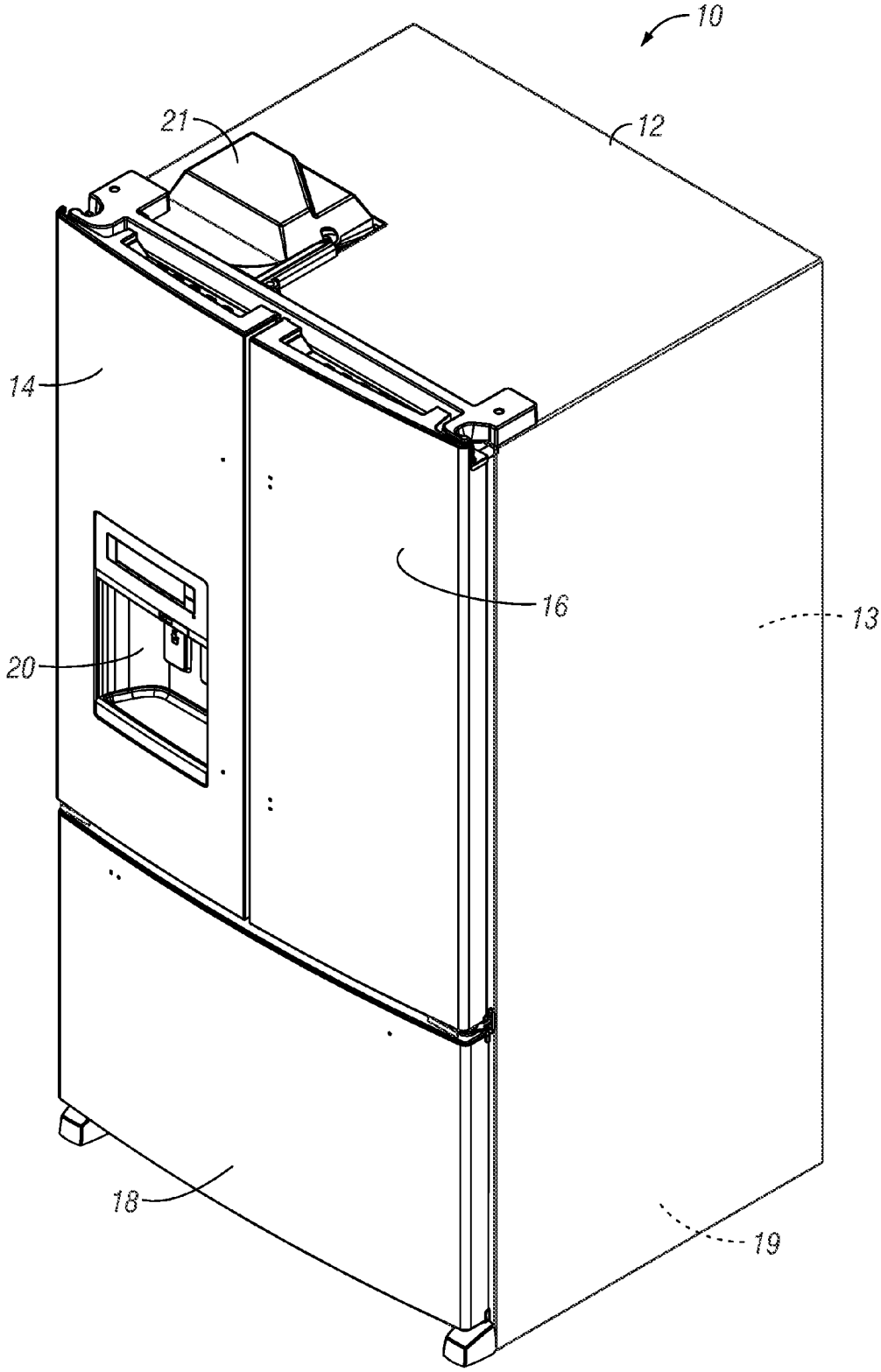
FIG. 1 is a perspective view illustrating one embodiment of a refrigerator with a backlight for illuminating an ice storage area.

FIG. 1 is a perspective view illustrating one embodiment of a refrigerator which provides backlighting for an ice container or ice bin located at the refrigerator door. The refrigerator 10 has a refrigerator housing or cabinet 12. The cabinet is an insulated cabinet. A left refrigerator door 14 and a right refrigerator door 16 provide access to a fresh food compartment 13 disposed within the refrigerator cabinet 12. A freezer drawer 18 may be extended to provide access to items stored in a freezer compartment 19 disposed within the refrigerator cabinet 12. A water and ice dispenser 20 is positioned on the left refrigerator door 14. An ice maker 21 is shown which is remote from the freezer compartment 19.

Figure 2A:
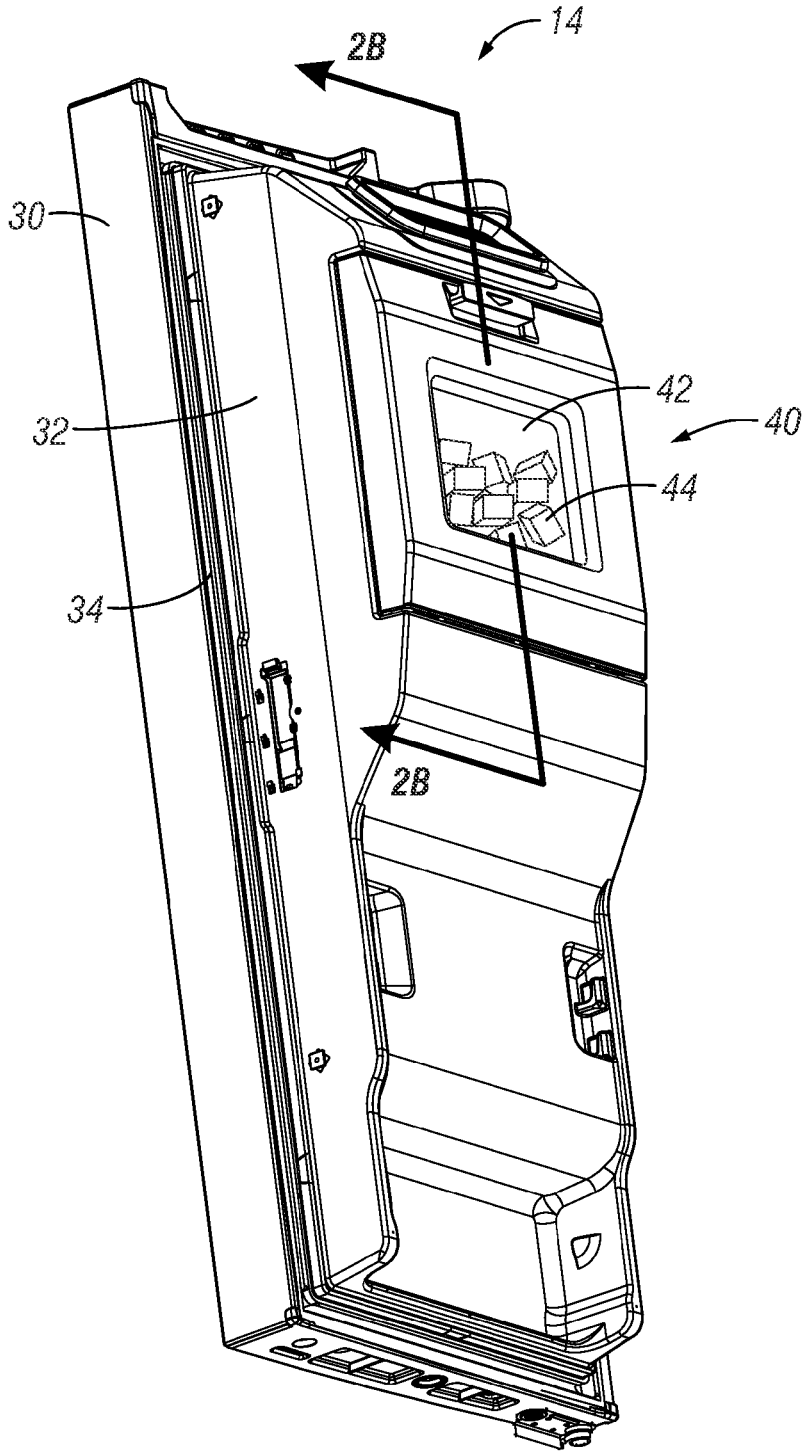
FIG. 2A is a perspective view showing an ice container on a fresh food compartment door of a refrigerator, with a backlight at the door for illuminating the ice storage area.

FIG. 2A is a perspective view showing an ice container 40 with a window 42 on a fresh food compartment door 14 of a refrigerator, with the ice container 40 in a closed position. In FIG. 2A, a door 14 has an outer case 30, an inner case 32, and a seal 34. An ice container 40 is mounted on the door 14. The ice container 40 is shown in a closed position. Because the ice container 40 is mounted to a door 14 of the fresh food compartment, the ice container 40 provides for insulating ice 44 within the ice bin. An ice container window 42 allows a user to see the ice level of the ice 44 within the ice container 40 without opening the ice container 40. Instead of the ice container window 42, other configurations may be used, as the ice container window 42 need not be present. The ice container window, where present, is made of a light transmitting material such as a plastic which may be transparent, frosted, or otherwise textured. Instead of having a window 42, the ice container 40 may be formed from a light transmitting material such as a clear plastic, or a portion of the ice container 40 may be formed from a light transmitting material such as a clear plastic.

Figure 2B:
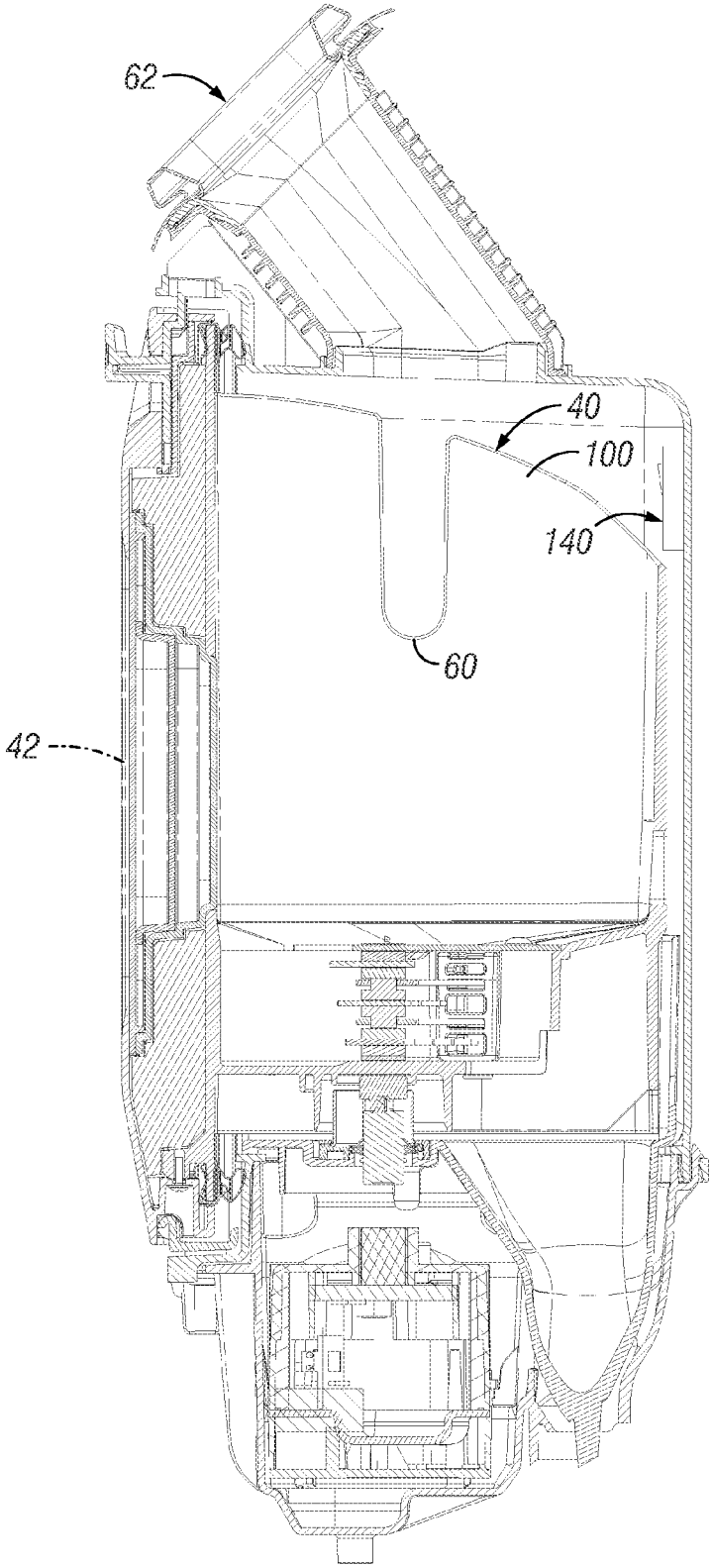
FIG. 2B is a perspective view illustrating the fresh food compartment door of a refrigerator, with an ice container and a backlight for illuminating the ice bin.

FIG. 2B is a perspective view illustrating the ice container 40 on a fresh food compartment door 14 of a refrigerator. As shown in FIG. 2B, an LED assembly 140 is positioned proximate the ice container 40. This allows ice which is contained in the ice container 40 to be illuminated to thereby assist a user of the refrigerator who wishes to check the level of ice in the ice container. The LED assembly 140 may be positioned above or behind the ice container or in other locations proximate the ice container to allow for the LED assembly 140 to illuminate the ice container and its contents. A slot 60 is shown in the ice container 40. An ice chute 62 is shown which allows ice and cold air from a remote location, such as a remote ice maker to convey ice or ice and below freezing air to the ice container 40.

Figure 3:
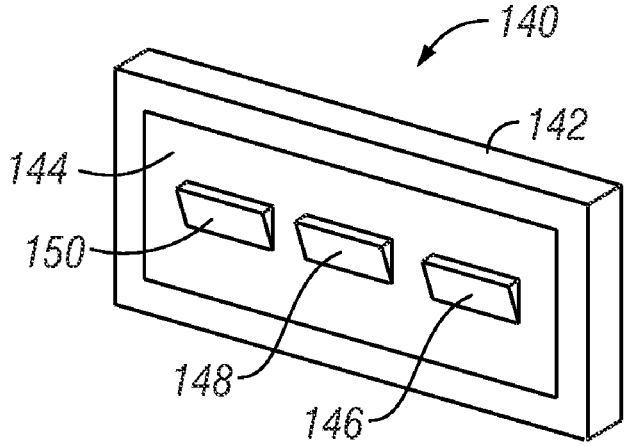
FIG. 3 illustrates an LED assembly.

FIG. 3 illustrates an LED assembly 140. The LED assembly 140 includes a housing 142 with a LED mounting board 144. LEDs 156, 148, 150 are mounted to the LED mounting board 144. The LEDs may be high intensity LEDs for providing directional lighting. The LED assembly 140 is mounted proximate the ice container to provide for illuminating contents of the ice bin.

Figures 4A, 4B, 5:
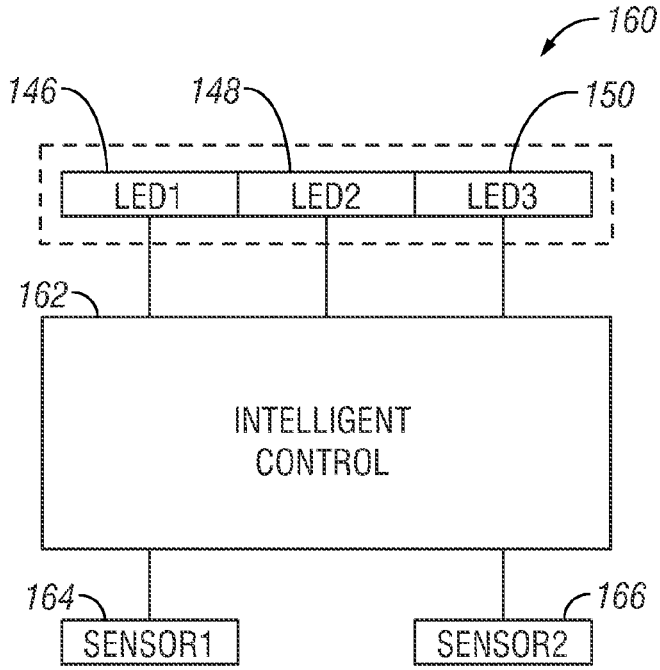
FIG. 4A and FIG. 4B provide tables regarding use of LEDs to indicate status information associated with a refrigerator.
FIG. 5 is a block diagram illustrating control of the LEDs.

The present invention contemplates that the LEDs may be used for other purposes besides lighting the contents of the ice bin. FIG. 4A provides a table illustrated how the LEDs may provide feedback associated with alert conditions. For example, the LEDs may be used to indicate the level of ice in the ice container or whether the ice container is seated properly. For example, LEDs may remain continuously on to indicate that the ice container is full. This also provides illumination of the ice as well so that a person may inspect the contents of the ice container if they wish to confirm. The LEDs may flash at different intervals to indicate different alert conditions. For example, the LEDs may flash for 1 second to indicate that the ice container is empty. The LEDs may flash for 2 seconds to indicate that the ice container is in a tilted position. The LEDs may flash for 3 seconds to indicate that the ice container is not docked. The flashing may be a one time event or may repeat after a period with the LEDs being an off state. These status or alert conditions are merely representative, as the present invention contemplates that any number of status or alert conditions may be represented. It is further contemplated that the refrigerator may be placed in a showroom mode where the LEDs may remain on when the door of the refrigerator is opened or the refrigerator may cycle through various modes to demonstrate the various modes.

Where multiple LEDs are used, the present invention contemplates that different LEDs may be in different states. For example, three different LEDs may be used and each LED may be either continuously on, continuously off, or flashing in order to indicate a particular state. FIG. 4B illustrates one example where different states or conditions are represented in this manner.

In FIG. 5, an electronic control system 160 includes an intelligent control 162 electrically connected to LEDs 146, 148, 150. A first sensor 164 and a second sensor 166 are also electrically connected to the intelligent control 162. The intelligent control may be a microcontroller, microprocessor, integrated circuit, or other type of intelligent control. The intelligent control may be associated with other types of controls and functions, such as those associated with a user interface or temperature control of the refrigerator. The intelligent control is programmed or otherwise configured to represent different states or alerts or conditions using the LEDs 146, 148, 150. The intelligent control 162 may also receive signals from the sensors 164, 166 to assist in determining which state or alert or conditions are present. The sensors 164, 166 may be position sensors or contact sensors for determining the position of the ice bin, such as whether it is titled or removed, or not properly placed or aligned. The sensors 164, 166 may be strain sensors for estimating the weight of ice in the ice bin, or the sensors 164, 166 may be any number of other types of sensors which may be used to sense signals useful in determining states or alerts or conditions which can be indicated by the one or more LEDs 146, 148, 150.

Figure 6:
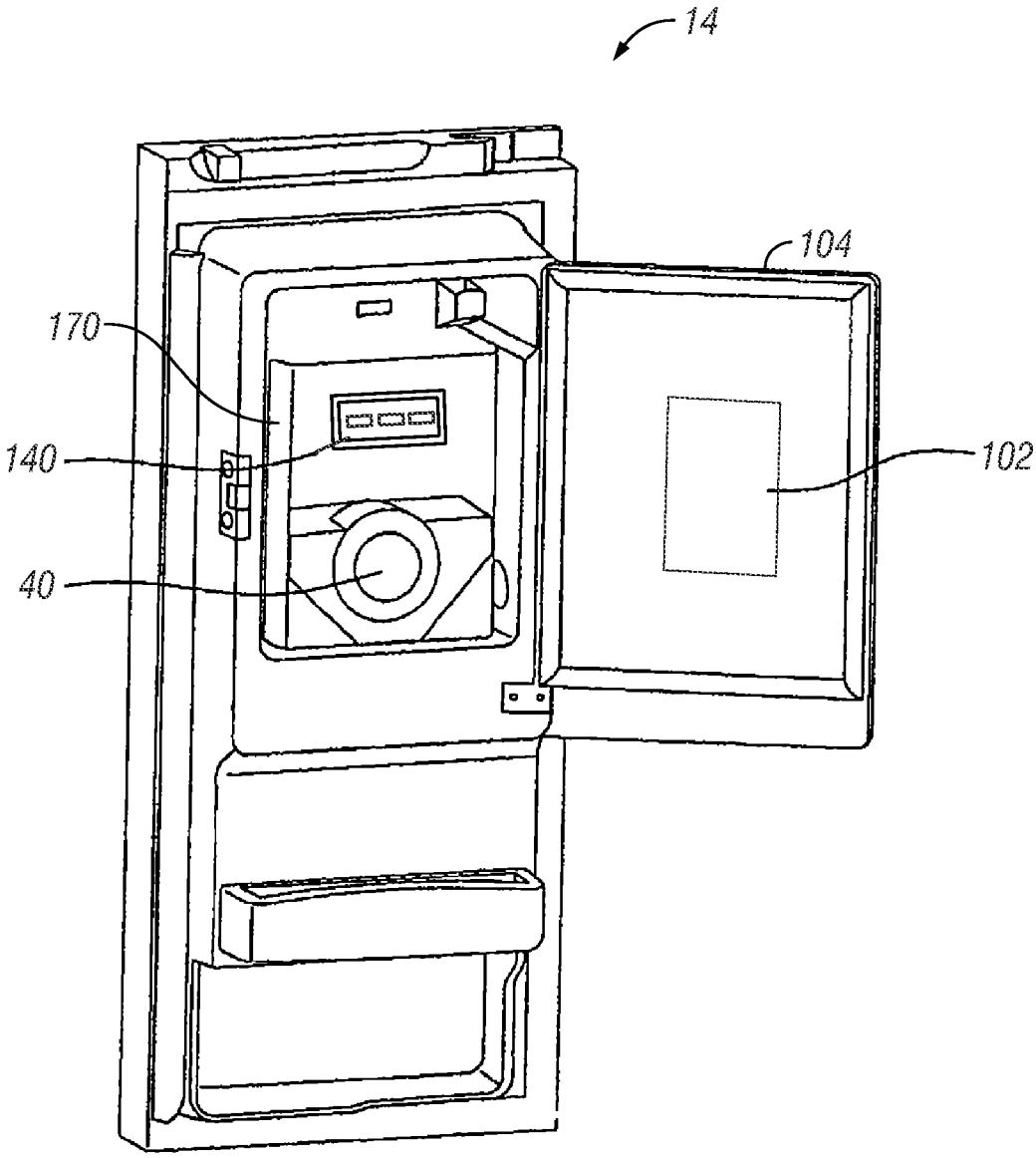
FIG. 6 illustrates another embodiment of a refrigerator.

FIG. 6 is another embodiment of the present invention. In FIG. 6, the LED assembly 140 is positioned proximate an ice container 40, such as above and towards the back of the ice container 40. FIG. 6 illustrates an enclosed ice storage area 170 with a window 102 on a door 104. The LED assembly 140 illuminates the ice storage area 170, so that a user may look through the window 102 and see the level of ice in the container 40, or to better see the level of ice in the container 40 when the ice storage area 170 is opened using the door 104.

The present invention contemplates numerous variations, options, and alternatives, including variations in the structure or configuration of the refrigerator, variations in the placement of the LED assembly, the number of lights used, the manner in which the lighting is controlled, and other variations. The present invention is not to be limited to the specific embodiments described herein or combinations of the specific embodiments described.

What is claimed is:

1. A refrigerator, comprising:
- a refrigerator cabinet;
- at least one compartment disposed within the refrigerator cabinet;
- a door for providing access to one or more of the at least one compartment;
- an ice container at the door;
- an LED housing proximate the ice container;
- at least one LED disposed within the LED housing for providing illumination of the ice container.

2. The refrigerator of claim 1 further comprising an electronic control system operatively connected to the at least one LED.

3. The refrigerator of claim 2 wherein the electronic control system being configured to determine an alert condition and indicate the alert condition using the at least one LED.

4. The refrigerator of claim 3 wherein the alert condition being indicative that the ice container is not properly connected to the door.

5. The refrigerator of claim 3 wherein the alert condition being indicative that the ice is substantially empty.

6. The refrigerator of claim 3 wherein the electronic control system being adapted to flash the at least one LED.

7. The refrigerator of claim 1 wherein the at least one compartment includes a fresh food compartment and a freezer compartment.

8. The refrigerator of claim 7 wherein the door is a fresh food compartment door.

9. The refrigerator of claim 1 wherein the LED housing being positioned proximate a top of the ice container.

10. The refrigerator of claim 1 wherein the ice container being formed at least partially of a light transmitting material.

11. A refrigerator, comprising:
- a housing;
- a fresh food compartment within the housing;
- a freezer compartment within the housing;
- a fresh food compartment door for providing access to the fresh food compartment;
- a freezer compartment door for providing access to the freezer compartment;
- an icemaker within the housing;
- an ice storage container operatively connected to the fresh food compartment door, the ice storage container being at least partially formed from a clear plastic material;
- at least one LED positioned on the fresh food compartment door for illuminating the ice storage container.

12. The refrigerator of claim 11 further comprising an electronic control system operatively connected to the at least one LED.

13. The refrigerator of claim 12 wherein the electronic control system being configured to determine an alert condition and indicate the alert condition using the at least one LED.

14. The refrigerator of claim 13 wherein the alert condition being indicative that the ice container is not properly connected to the door.

15. The refrigerator of claim 13 wherein the alert condition being indicative that the ice storage container is substantially empty.

16. The refrigerator of claim 13 wherein the electronic control system being adapted to flash the at least one LED.

17. The refrigerator of claim 11 wherein the at least one LED being positioned above the ice storage container.

18. A refrigerator, comprising:

a refrigerator cabinet;

at least one compartment disposed within the refrigerator cabinet;

a door for providing access to one or more of the at least one compartment;

an ice container at the door, the ice container being at least partially formed of a light transmissive material;

an LED housing proximate the ice container;

at least one LED disposed within the LED housing for providing illumination of the ice container;

an electronic control system operatively connected to the at least one LED and adapted for controlling the at least one LED to provide status information.

19. The refrigerator of claim 18 wherein the status information being indicative of an alert condition.

20. The refrigerator of claim 19 wherein the ice container is a removable ice container.

21. The refrigerator of claim 20 wherein the status information being indicative of position of the removable ice container.

22. The refrigerator of claim 18 wherein the controlling the at least one LED includes flashing the at least one LED.

* * * * *